US007343891B1

(12) United States Patent
Chang

(10) Patent No.: US 7,343,891 B1
(45) Date of Patent: Mar. 18, 2008

(54) STARTING DEVICE FOR A MODEL ENGINE

(75) Inventor: Lien Sheng Chang, Taichung Shien (TW)

(73) Assignee: Golden Lion Enterprise Co., Ltd., Taichung Shien (TW)

( * ) Notice: Subject to any disclaimer, the term of this patent is extended or adjusted under 35 U.S.C. 154(b) by 0 days.

(21) Appl. No.: 11/509,823

(22) Filed: Aug. 25, 2006

(51) Int. Cl.
*F02N 3/02* (2006.01)

(52) U.S. Cl. ..... 123/185.3

(58) Field of Classification Search ..... 123/179.1, 123/179.24, 179.25, 185.1, 185.2, 185.3, 123/185.6; 74/6, 7 C, 8; 185/39, 40 R, 185/41 A See application file for complete search history.

(56) References Cited

U.S. PATENT DOCUMENTS 5,765,438 A * 6/1998 Chang ..... 74/6
6,994,066 B2 * 2/2006 Liu ..... 123/185.3
6,997,155 B1 * 2/2006 Lu ..... 123/179.25
2002/0139341 A1 * 10/2002 Tsuno ..... 123/185.3
2003/0037750 A1 * 2/2003 Ueda et al. ..... 123/185.14
2003/0079558 A1 * 5/2003 Muehlbauer ..... 74/6
2004/0134293 A1 * 7/2004 Lai ..... 74/6
2005/0268876 A1 * 12/2005 Liu ..... 123/185.3

* cited by examiner

*Primary Examiner*—Stephen K. Cronin
*Assistant Examiner*—Ka Chun Leung
(74) *Attorney, Agent, or Firm*—Ming Chow; Sinorica, LLC

(57) ABSTRACT

A starting device for a model engine includes an electric-operation unit and a rope-operation unit. The electric-operation unit consists of an engage wheel having engage teeth elastically engaged thereon, and a starting shaft slidably fitted at the outer side of the engage wheel. The starting shaft has its inner side bored with a fitting slot having its circumference eccentrically cut with plural arc-shaped grooves matching with the engage teeth of the engage wheel. The arc-shaped grooves of the starting shaft can eccentrically actuate the engage teeth to move back and forth axially on the engage wheel. The rope wheel of the rope-operation unit is fitted on the starting shaft, having its inner side equidistantly and annularly bored with plural tooth grooves elastically engaged by the engage teeth. By changing the positions of the engage teeth, the starting device can be started in two different modes.

5 Claims, 8 Drawing Sheets

STARTING DEVICE FOR A MODEL ENGINE

BACKGROUND OF THE INVENTION

1. Field of the Invention

This invention relates to a starting device for a model engine, particularly to one able to start the engine both manually and electrically.

2. Description of the Prior Art

Generally, a starting device for a conventional model engine is able to start the engine both manually and electrically. The starting device 10 of the conventional model engine, as shown in FIG. 1, is mainly composed of a housing 11 and a transmission mechanism 12. The transmission mechanism 12 received in the accommodating hollow 111 of the housing 11 is provided with a driving rod 121 inserted in the interior of the housing 11 to be connected with the crank of the engine and orderly fitted thereon with a first shaft coupler 122, a driving member 123, a winding wheel 124 and a second shaft coupler 125. The first shaft coupler 122 has its center fitted axially with a first one-way bearing 1221, the driving member 123 has its center fitted axially with a second one-way bearing 1231 and the winding wheel 124 has a pull rope 126 wound thereon. When the second shaft coupler 125 is actuated to operate by manually pulling the pull rope 126 or by electric operation, the second one-way bearing 1231 or the first one-way bearing 1221 will be driven to rotate and start the engine.

However, the starting device 10 of the conventional model engine has to install two one-way bearings in order to start the engine both manually or electrically, thus increasing cost in producing the starting device because the manufacturing cost of two one-way bearings is quite high.

SUMMARY OF THE INVENTION

The objective of this invention is to offer a starting device for a model engine, which includes an outer housing, an electric-operation unit and a rope-operation unit. The outer housing is firmly combined on a model engine and bored with an accommodating hollow for receiving the electric-operation unit and the rope-operation unit. The electric-operation unit consists of an engage wheel and a starting shaft. The engage wheel is firmly fitted on the outer side of the input rod of the engine and provided with engage teeth preset in number, which are respectively formed with a positioning shaft protruding outward. The starting shaft is slidably assembled on the engage wheel and has its inner side eccentrically bored with plural arc-shaped grooves for the positioning shafts of the engage wheel to slide and position therein. Further, the starting shaft has its outer end fitted with the rope wheel of the rope-operation unit, and the rope wheel has its inner side facing the starting shaft equidistantly and annularly bored with plural gradually-enlarged tooth grooves preset in multiple of the engage teeth of the engage wheel to be elastically engaged and restricted in position by the engage teeth of the engage wheel. When the model engine is started to rotate by the starting shaft of the electric-operation unit, the arc-shaped grooves of the starting shaft will actuate the engage teeth to shift toward the shaft center and disengage from the gradually enlarged tooth grooves. When the model engine is started by the rope-operation unit, the gradually-enlarged tooth grooves of the rope wheel will be engaged and restricted in position by the engage teeth of the engage wheel and simultaneously the engage teeth will drive the starting shaft to rotate. The starting device for a model engine of this invention is simple in structure and able to reduce producing cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
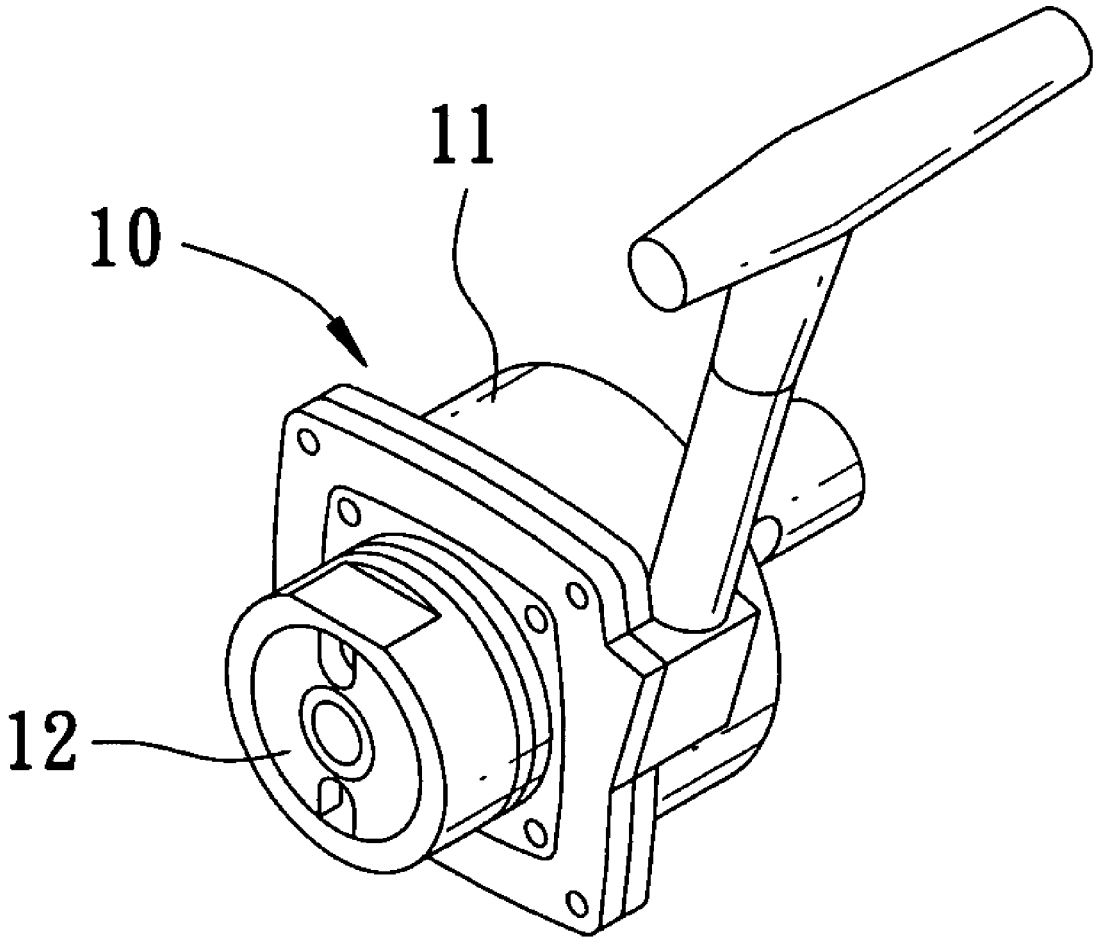
FIG. 1 PRIOR ART
FIG. 1 is a perspective view of a starting device for a conventional model engine.
Figure 2:
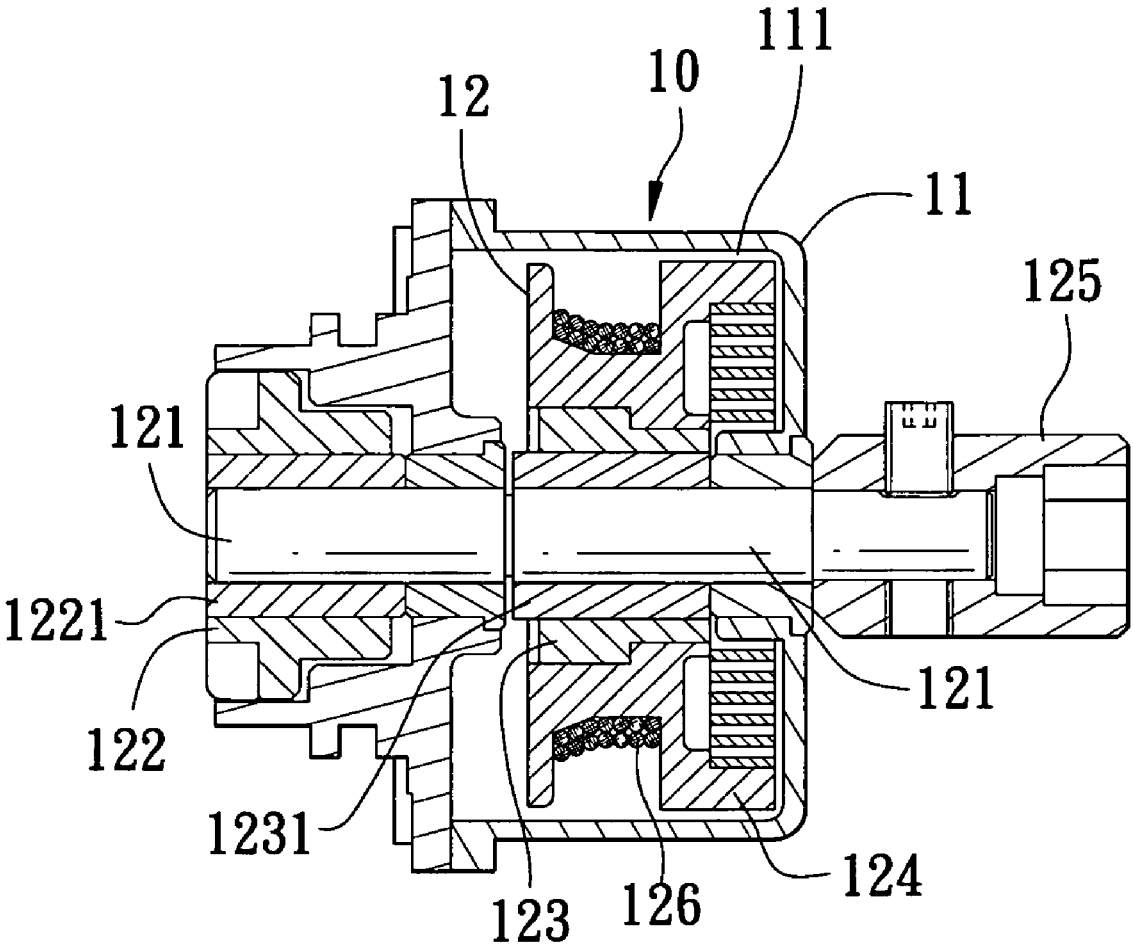
FIG. 2 PRIOR ART
FIG. 2 is a cross-sectional view of the starting device for a conventional model engine.
Figure 3:
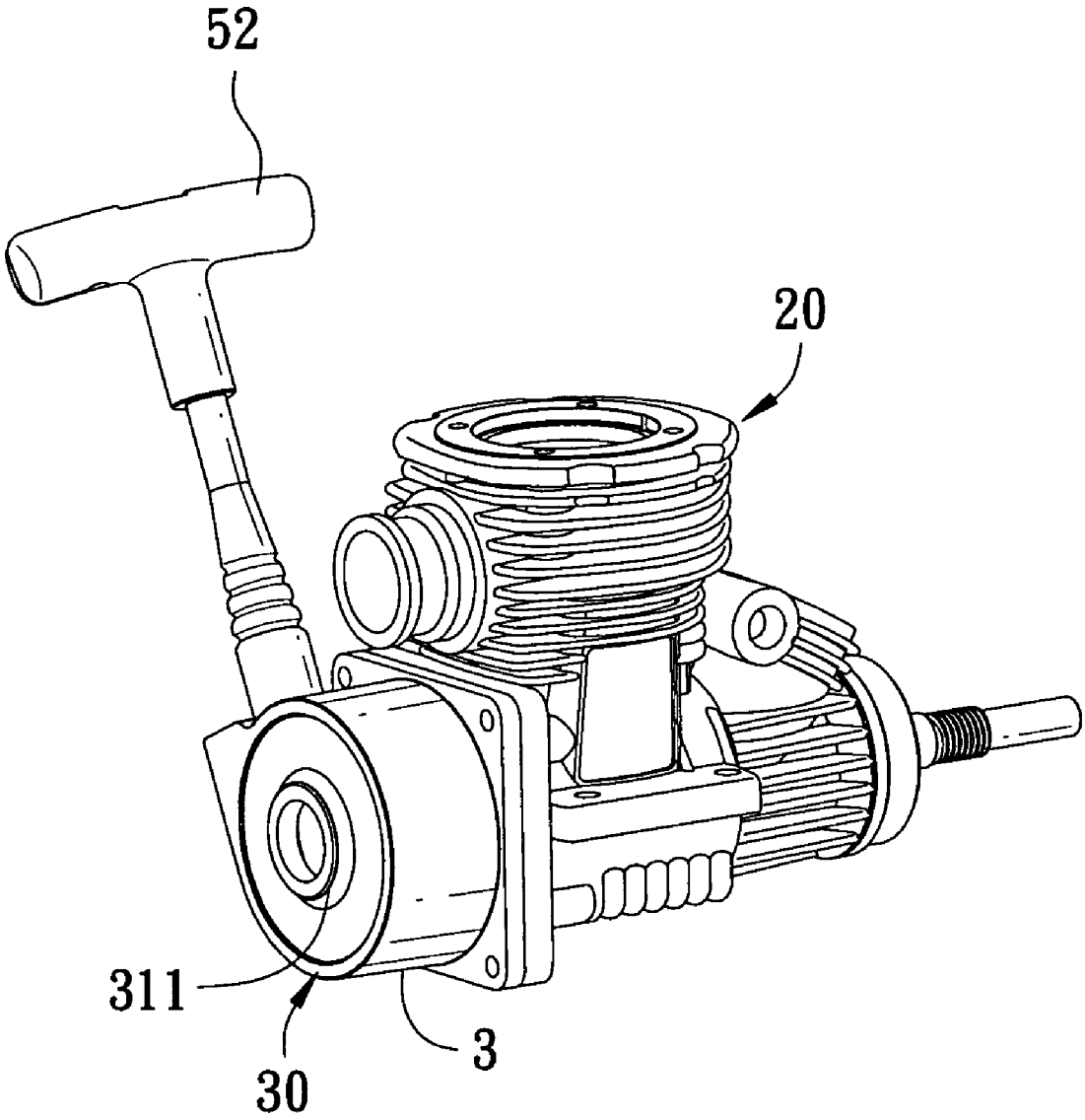
FIG. 3 is a perspective view of a starting device for a model engine in the present invention.
Figure 4:
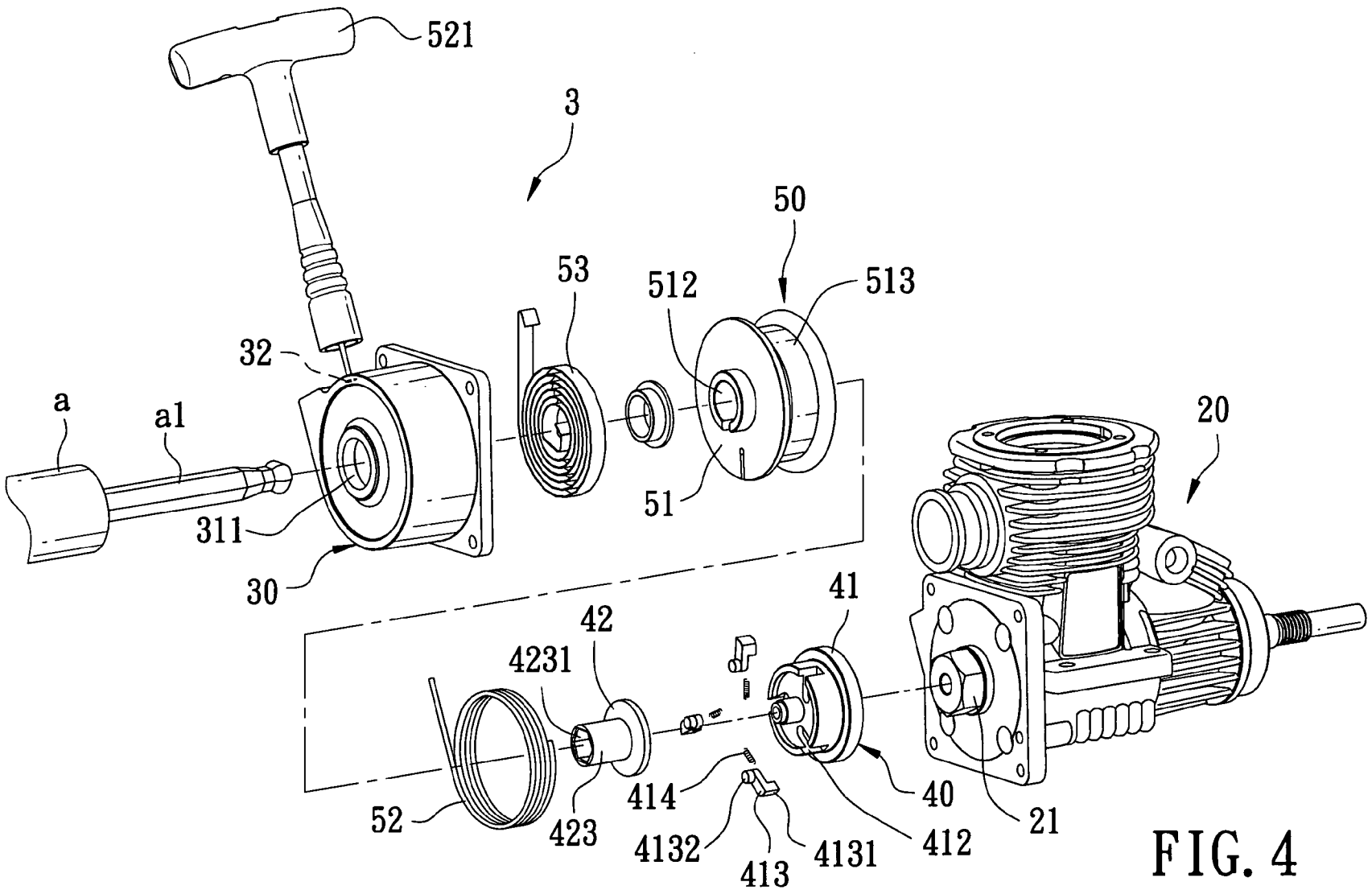
FIG. 4 is an exploded perspective view of the starting device for a model engine in the present invention.

A preferred embodiment of a starting device for a model engine in the present invention, as shown in FIGS. 3 and 4, includes a model engine 20, a starting device 3, an electric-operation unit 40 and rope-operation unit 50 as main components combined together.

The model engine 20 has its outer side fixed with a hexagonal input rod 21 extending outward horizontally.

Figure 5:
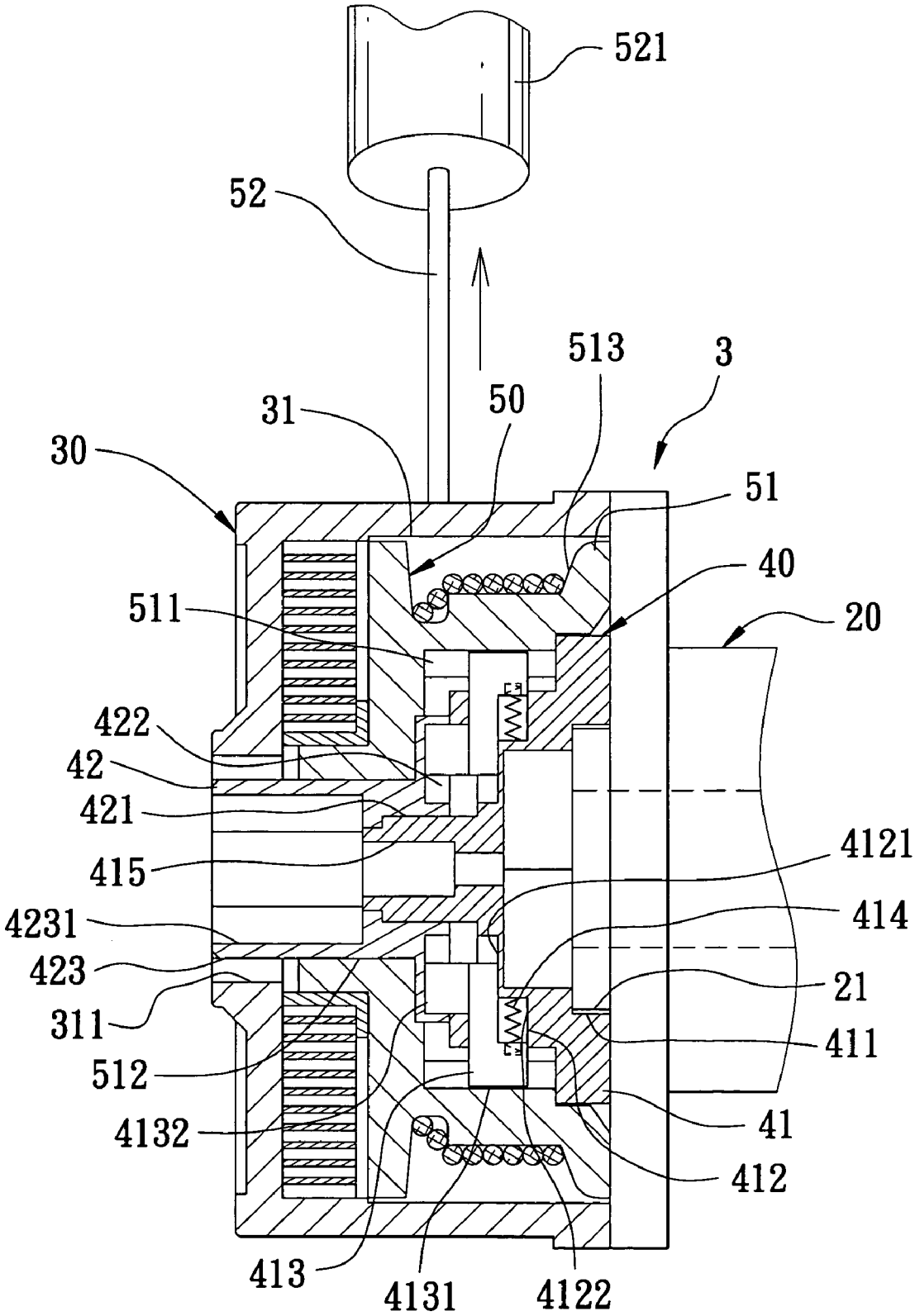
FIG. 5 is a cross-sectional view of the starting device starting the engine under manually started condition in the present invention.
Figure 6:
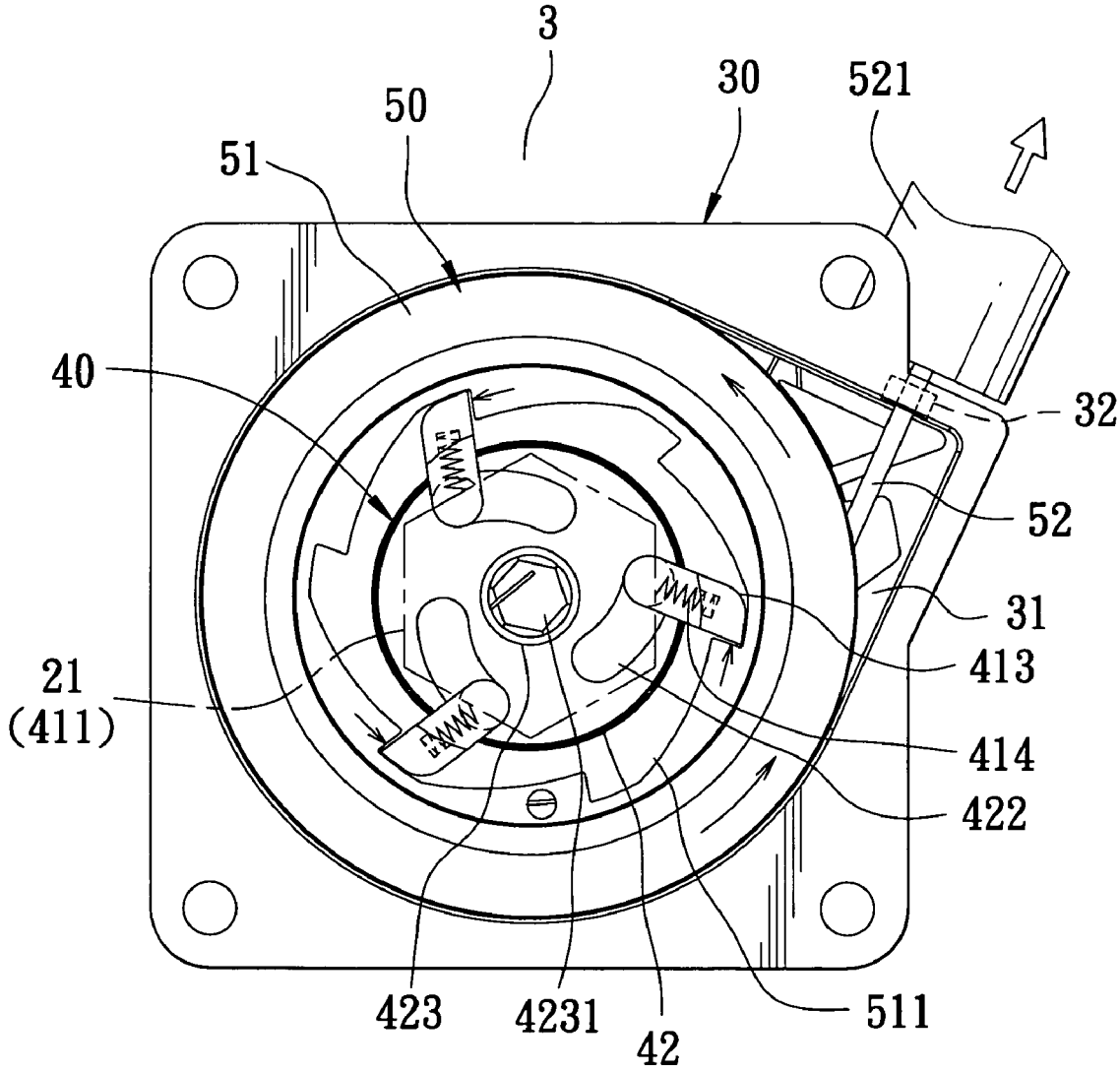
FIG. 6 is a side cross-sectional view of the starting device starting the engine under manually started condition in the present invention.

The starting device 3 is firmly fitted on the input rod 21 of the model engine 20, able to drive the input rod 21 to rotate. The starting device 3, referring to FIGS. 5 and 6, is formed with an outer housing 30 to be mounted on the outer side of the engine 20. The housing 30 has its inner side formed with an accommodating hollow 31 receiving therein the electric-operation unit 40 and the rope-operation unit 50. The accommodating hollow 31 has its center bored with an outward hole 311, and the housing 30 has one side wall bored with a rope hole 32.

The electric-operation unit 40 is mainly composed of an engage wheel 41 and a starting shaft 42. The engage wheel 41 is made of a disk, having its inner side bored with a hexagonal combining groove 411 to be firmly fitted on the outer side of the input rod 21 of the engine 20 and its outer side axially and eccentrically bored with engage notches 412 preset in number, which are respectively composed of an engage tooth groove 4121 and a spring groove 4122. Each engage notch 412 has its interior receiving an engage tooth 413 and an elastic member 414, and the engage tooth 413 is elastically engaged in the engage tooth groove 4121 and the elastic member 414 (a compression spring) electrically positioned in the spring groove 4122. Each engage tooth 413 has its upper end formed with a protruding elastic end 4131 for restrictingly positioning the elastic member 414 in the spring groove 4122 and has its lower outer side disposed with a positioning shaft 4132 extending outward. Further, the engage wheel 41 is fixed with a fitting rod 415 extending outward from the center. The starting shaft 42 has its inner end bored with a fitting slot 421 to be slidably fitted around the fitting rod 415 of the engage wheel 41. The fitting slot 421 of the starting shaft 42 has its circumference eccentrically bored with plural arc-shaped grooves 422 for respectively receiving the engage teeth 413 of the engage wheel 41, with the positioning shaft 4132 of the engage tooth 413 slidably positioned in the arc-shaped groove 422. Thus, when the arc-shaped grooves 422 are rotated, the positioning shafts 4132 will be driven to rotate and actuate the engage teeth 413 to move back and forth axially in the engage notches 412. Furthermore, the starting shaft 42 has the opposite side of the fitting slot 421 provided with a coupling rod 423 extending outward axially and having its center bored with a hexagonal starting slot 4231.

The rope-operation unit 50 includes a rope wheel 51, a pull rope 52 and a restoring elastic member 53. The rope wheel 51 has its center equidistantly and annularly bored with six gradually enlarged tooth grooves 511. The rope wheel 51 is further bored with an insert hole 512 in the center of the six gradually-enlarged tooth grooves 511, having its outer circumference formed with an annular rope recess 513. The coupling rod 423 of the starting shaft 42 is inserted through the insert hole 512 of the rope wheel 51 and pivotally fitted in the outward hole 311 of the housing 30. The engage wheel 41 is received in the gradually enlarged tooth grooves 511, having its engage teeth 413 respectively and elastically engaged in the gradually enlarged tooth grooves 511. The pull rope 52 is wound in the rope recess 513 of the rope wheel 51 to be drawn for actuating the rope wheel 51 to rotate, having one end secured on the rope pulley 51 and the other end inserted out of the rope hole 32 of the housing 30 and connected with a pull handle 521. The restoring elastic member 53 has one end secured on the rope wheel 51 and the other end fixed in the accommodating hollow 31 of the housing 30. Thus, when the pull rope 52 is drawn to turn the rope wheel 51, the restoring elastic member 53 will be compressed to produce a resilience restoring force.

In using, as shown in FIGS. 5 and 6, when the model engine 20 needs to be started by manually drawing the pull rope 52, the pull rope 52 is first drawn to actuate the rope wheel 51 to rotate, and simultaneously the engage teeth 413 of the engage wheel 41 will be forced by the elastic member 414 to be respectively engaged in the gradually-enlarged tooth grooves 511. When actuated to rotate, the rope wheel 51 will actuate the engage wheel 41 together with the input rod 21 of the engine 20 to rotate. When the pull rope 52 is drawn, the restoring elastic member 53 will be compressed to produce a resilience restoring force, and when the drawing force of the pull rope 52 vanishes, the rope pulley 51 will be forced by the restoring elastic member 53 to rotate reversely and the pull rope 52 will be rewound around the rope recess 513 of the rope wheel 51.

Figure 7:
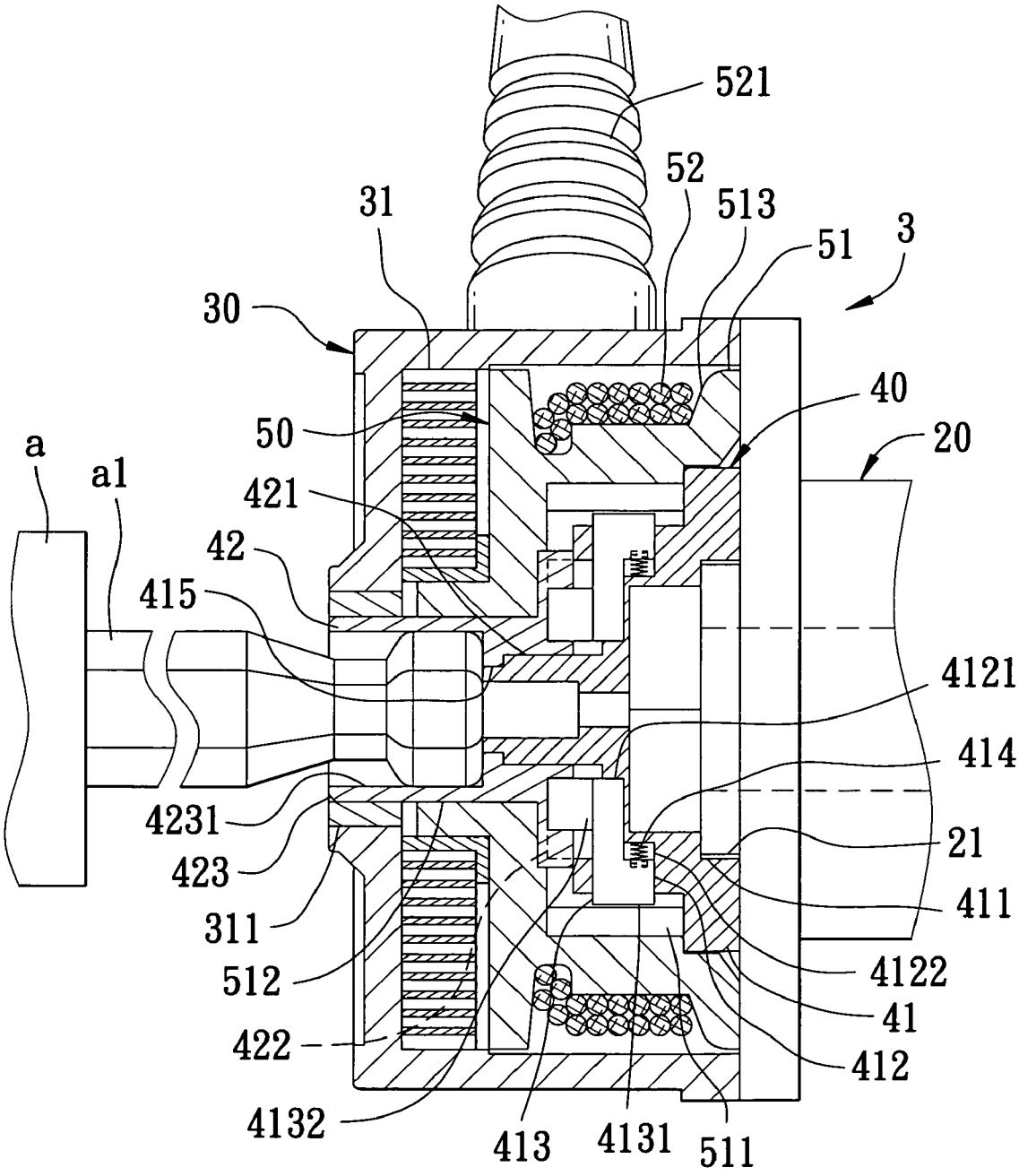
FIG. 7 is a cross-sectional view of the starting device starting the engine under electrically started condition in the present invention.
Figure 8:
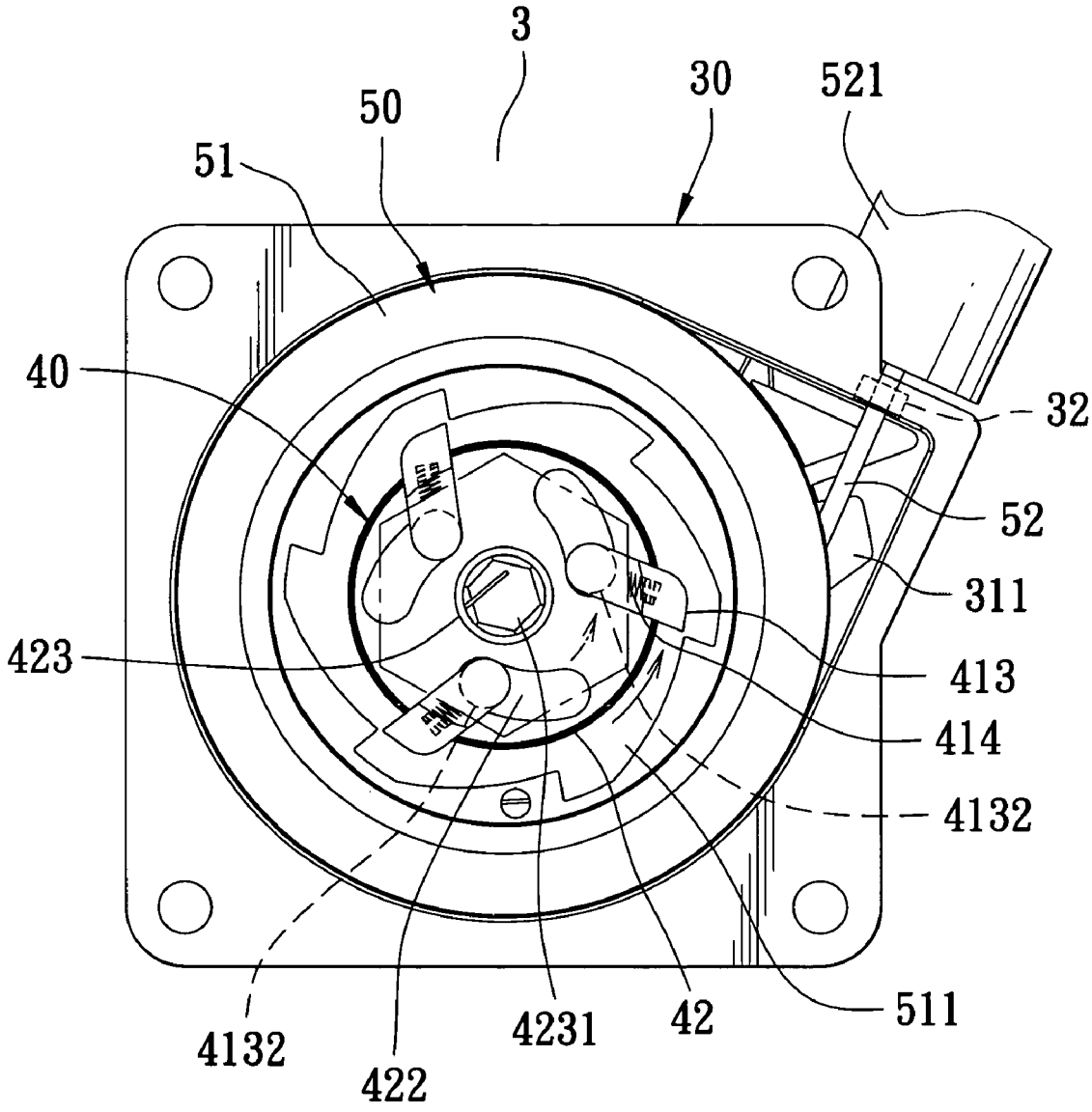
FIG. 8 is a side cross-sectional view of the starting device starting the engine under electrically started condition in the present invention.

Referring to FIGS. 7 and 8, when the model engine 20 needs to be started by an electric motor (a), the coupling rod (a1) of the electric motor (a) is inserted in the starting groove 4231 of the starting shaft 42 to drive the starting shaft 42 to rotate. At this time, the arc-shaped grooves 422 of the starting shaft 42 will actuate the positioning shafts 4132 of the engage tooth 413 to move nearer to the center end, and simultaneously the engage teeth 413 will axially be moved toward the shaft center, and the elastic ends 4131 will be actuated to compress the elastic members 414, letting the engage teeth 413 disengaged from the gradually-enlarged tooth grooves 511. Thus, when started by the electric motor (a), the starting shaft 42 will directly drive the engage wheel 41 and the input rod 21 of the engine 20 to rotate synchronously. When the electric motor (a) is removed from the starting shaft 42, the elastic members 414 will produce a resilience restoring force to push the engage teeth 413 outward, and meanwhile the positioning shafts 4132 will be moved to the outer circumferential end of the arc-shaped groove 422 and the engage teeth 413 will be elastically engaged in the gradually-enlarged tooth grooves 511.

As can be understood from the above description, this invention has the following advantages.

1. The starting device for a model engine in the present invention is provided with the electric-operation unit and the rope-operation unit for starting the engine with different modes by changing the position of the engage teeth in the arc-shaped grooves, simple in structure, lowering the frequency of maintenance, and able to reduce producing cost and enhance market competitive force.

2. The starting device is composed of only a few components, and the electric-operation unit is received in the rope wheel, thus reducing the weight and the size of the starting device and the model car, and enhancing speeds and facilitating control of the model car.

3. The starting device is received in the interior of the housing, so the inner components of the starting device can be protected from being damaged, able to prolong the service life of the starting device.

While the preferred embodiment of the invention has been described above, it will be recognized and understood that various modifications may be made therein and the appended claims are intended to cover all such modifications that may fall within the spirit and scope of the invention.

I claim:

1. A starting device for a model engine comprising an input rod extending outward at one outer side of a model engine, said starting device firmly fitted on said input rod for actuating said input rod and said model engine to rotate; and characterized by:

Said starting device composed of a housing, an electric-operation unit and a rope operation unit;

Said housing secured on said model engine, said housing formed with an accommodating hollow for receiving said electric-operation unit and said rope operation unit, said accommodating hollow bored with an outward hole in the center;

Said electric-operation unit composed of an engage wheel and a starting shaft, said engage wheel made of a disk firmly fitted on the outer side of said input rod of said model engine, said engage wheel having its outer side axially and eccentrically cut with engage notches preset in number, said engage notches respectively receiving therein an engage tooth and an elastic member, said engage tooth having its lower outer side formed with a positioning shaft protruding outward, said engage wheel having the center of its outer side fixed with a fitting rod extending outward, said starting shaft having its inner side formed with a fitting slot to be fitted on said fitting rod of said engage wheel, said fitting slot having its circumference eccentrically bored with plural arc-shaped grooves corresponding with said engage teeth of said engage wheel, said positioning shafts of said engage teeth respectively and slidably received in said arc-shaped grooves of said starting shaft, said arc shaped grooves rotated to actuate said positioning shafts to turn and force the engage teeth to move back and forth axially in said engage notches, said starting shaft having its outer side disposed with a coupling rod extending outward axially, said coupling rod bored with a starting groove in the center; and, said rope-operation unit composed of a rope wheel, a pull rope and a restoring elastic member, said rope wheel fitted around said coupling rod of said starting shaft, said rope wheel having its inner side facing said coupling rod of said starting shaft equidistantly and annularly bored with plural tooth grooves of a multiple number of said engage teeth of said engage wheel, said tooth grooves of said rope wheel engaged and restricted in position by said engage teeth of said engage wheel, said pull rope wound around said rope wheel to be drawn for turning said rope wheel, said restoring elastic member combined with said rope pulley, said restoring elastic member able to produce a resilience restoring force when said pull rope is drawn.

2. The starting device for a model engine as claimed in claim 1, wherein said engage notch of said engage wheel is composed of an engage tooth groove and a spring groove, said engage tooth positioned in said engage tooth groove and having its upper end formed with an elastic end protruding toward one side of said engage notch, said elastic member elastically positioned between said spring groove and said elastic end.

3. The starting device for a model engine a claimed in claim 1 or 2, wherein said elastic member is a compression spring.

4. The starting device for a model engine as claimed in claim 1, wherein said input rod has its front end formed with a hexagonal member, and said engage wheel has its inner side bored with a hexagonal combining groove for said input rod to be fitted therein tightly.

5. The starting device for a model engine as claimed in claim 1, wherein said rope wheel is equidistantly and annularly formed with plural gradually-enlarged tooth grooves in the center and bored with an insert hole in the center of said gradually-enlarged tooth grooves, said coupling rod of said starting shaft inserted through said insert hole of said rope wheel, said engage wheel received in said gradually-enlarged tooth grooves, said engage teeth of said engage wheel respectively and elastically engaged in said gradually-enlarged tooth grooves.

* * * * *